US007841018B2

(12) United States Patent
Kotoske

(10) Patent No.: US 7,841,018 B2
(45) Date of Patent: Nov. 30, 2010

(54) BASEBALL CATCHER'S EQUIPMENT

(76) Inventor: Thomas G. Kotoske, 7110 N. Quartz Mountain Rd., Paradise Valley, AZ (US) 85253

( * ) Notice: Subject to any disclaimer, the term of this patent is extended or adjusted under 35 U.S.C. 154(b) by 57 days.

(21) Appl. No.: 12/120,859

(22) Filed: May 15, 2008

(65) Prior Publication Data

US 2009/0282609 A1 Nov. 19, 2009

(51) Int. Cl.
*A41D 13/00* (2006.01)

(52) U.S. Cl. ..... 2/22

(58) Field of Classification Search ..... 2/16, 2/22, 24, 455, 242, 62, 911
See application file for complete search history.

(56) References Cited

U.S. PATENT DOCUMENTS 3,465,364 A 9/1969 Edelson
4,099,269 A 7/1978 Porner
4,633,529 A 1/1987 Litz
4,674,157 A 6/1987 Litz
5,375,262 A 12/1994 Carter
5,384,913 A 1/1995 Hendry
5,742,939 A * 4/1998 Williams ..... 2/69
5,742,945 A 4/1998 Lindaman
D394,543 S 5/1998 Lindaman
D395,158 S 6/1998 Lindaman
5,926,844 A 7/1999 Bear
7,237,270 B2 * 7/2007 Crye et al. ..... 2/24
7,380,283 B1 * 6/2008 Dumont ..... 2/23

* cited by examiner

*Primary Examiner*—Tejash Patel
(74) *Attorney, Agent, or Firm*—Barnes & Thornburg LLP

(57) ABSTRACT

A baseball catcher's equipment includes a baseball catcher's uniform sized to be worn by a child, a chest guard, and a shin guard. The baseball catcher's uniform includes a baseball catcher's uniform shirt and a baseball catcher's uniform pants. The baseball catcher's uniform, the chest guard, and the shin guard include corresponding hook-and-loop fastener pads configured to removably secure the chest guard and the shin guard to the baseball catcher's uniform.

10 Claims, 3 Drawing Sheets

BASEBALL CATCHER'S EQUIPMENT

FIELD OF THE DISCLOSURE

The present disclosure relates generally to protective equipment for a baseball catcher.

BACKGROUND OF THE DISCLOSURE

Baseball catcher shin guards and chest protectors are used to protect vulnerable areas of an athlete's body. For example, there are protection devices which are coupled to the body of a baseball catcher to protect the shins, knees, and also the thighs, shoulders, and torso.

SUMMARY OF THE DISCLOSURE

According to an aspect of the present disclosure, there are provided protection devices including a pair of shin guards and a chest protector. A number of hook-and-loop fastener portions are coupled to a rear surface of each shin guard and a rear surface of the chest protector. The fastener portions are sized and arranged to be coupled to corresponding hook-and-loop fastener portions coupled to an exterior surface of an athlete's clothing.

According to another aspect, an article includes a baseball catcher's uniform pants sized for use by a child and a shin guard sized for use by a child. The baseball catcher's uniform pants includes an exterior surface and a first hook-and-loop fastener pad coupled to the exterior surface. The shin guard includes a rear surface and a second hook-and-loop fastener pad coupled to the rear surface. The first hook-and-loop fastener pad and the second hook-and-loop fastener pad may be configured to mate with each other to removably secure the shin guard to the baseball catcher's uniform pants. In some embodiments, the first hook-and-loop fastener pad may be embodied as a hook type fastener pad and the second hook-and-loop fastener pad may be embodied as a loop type fastener pad. Alternatively, in other embodiments, the first hook-and-loop fastener pad may be embodied as a loop type fastener pad and the second hook-and-loop fastener pad may be embodied as a hook type fastener pad.

In some embodiments, the baseball catcher's uniform pants may include a plurality of first hook-and-loop fastener pads coupled to the exterior surface. In such embodiments, the shin guard may include a plurality of second hook-and-loop fastener pads coupled to the rear surface. Each of the plurality of second hook-and-loop fastener pads may be configured to mate with one of the plurality of first hook-and-loop fastener pads to removably secure the shin guard to the baseball catcher's uniform pants.

Additionally, in some embodiments, the shin guard includes an ankle guard portion having at least one second hook-and-loop fastener pad coupled thereto, a shin guard portion having at least one second hook-and-loop fastener pad coupled thereto, a knee guard portion having at least one second hook-and-loop fastener pad coupled thereto, and a thigh guard portion having at least one second hook-and-loop fastener pad coupled thereto. In such embodiments, each of the second hook-and-loop fastener pads may be configured to mate with a corresponding first hook-and-loop fastener pad coupled to exterior surface of the baseball catcher's uniform pants.

According to a further aspect, an article may include a baseball catcher's uniform shirt sized for use by a child and a chest guard sized for use by a child. The baseball catcher's uniform shirt includes an exterior surface and a first hook-and-loop fastener pad coupled to the exterior surface. The chest guard includes a rear surface and a second hook-and-loop fastener pad coupled to the rear surface. The first hook-and-loop fastener pad and the second hook-and-loop fastener pad may be configured to mate with each other to removably secure the chest guard to the baseball catcher's uniform shirt. In some embodiments, the first hook-and-loop fastener pad may be embodied as a hook type fastener pad and the second hook-and-loop fastener pad may be embodied as a loop type fastener pad. Alternatively, in other embodiments, the first hook-and-loop fastener pad may be embodied as a loop type fastener pad and the second hook-and-loop fastener pad may be embodied as a hook type fastener pad.

In some embodiments, the baseball catcher's uniform shirt may include a plurality of first hook-and-loop fastener pads coupled to the exterior surface. In such embodiments, the chest guard may include a plurality of second hook-and-loop fastener pads coupled to the rear surface. Each of the plurality of second hook-and-loop fastener pads may be configured to mate with one of the plurality of first hook-and-loop fastener pads to removably secure the chest guard to the baseball catcher's uniform shirt.

Additionally, in some embodiments, the chest guard may include a shoulder guard portion having at least one second hook-and-loop fastener pad coupled thereto, a chest and abdomen guard portion having at least one second hook-and-loop fastener pad coupled thereto, and a crotch guard portion. In such embodiments, each of the second hook-and-loop fastener pads are configured to mate with a corresponding first hook-and-loop fastener pad coupled to exterior surface of the baseball catcher's uniform shirt.

According to yet a further aspect, an article may include a baseball catcher's uniform sized for use by a child, a chest guard sized for use by a child, and a shin guard sized for use by a child. The baseball catcher's uniform includes a baseball catcher's uniform shirt having a first hook-and-loop fastener pad secured to an exterior surface and a baseball catcher's uniform pants having a first hook-and-loop fastener pad secured to an exterior surface. The chest guard includes a rear surface and a second hook-and-loop fastener pad coupled to the rear surface of the chest guard. The second hook-and-loop fastener pad of the chest guard may be configured to mate with the first hook-and-loop fastener pad of the baseball catcher's uniform shirt to removably secure the chest guard to the baseball catcher's uniform. The shin guard includes a rear surface and a second hook-and-loop fastener pad coupled to the rear surface of the shin guard. The second hook-and-loop fastener pad of the shin guard may be configured to mate with the first hook-and-loop fastener pad of the baseball catcher's uniform pants to removably secure the shin guard to the baseball catcher's uniform. In some embodiments, the first hook-and-loop fastener pads may be embodied as hook type fastener pads and the second hook-and-loop fastener pads may be embodied as loop type fastener pads. Alternatively, the first hook-and-loop fastener pads may be embodied as loop type fastener pads and the second hook-and-loop fastener pads may be embodied as hook type fastener pads.

In some embodiments, the baseball catcher's uniform may include a plurality of first hook-and-loop fastener pads. In such embodiments, the chest guard may include a plurality of second hook-and-loop fastener pads coupled to the rear surface of the chest guard. Each of the plurality of second hook-and-loop fastener pads may be configured to mate with one of the plurality of first hook-and-loop fastener pads of the baseball catcher's uniform to removably secure the chest guard to the baseball catcher's uniform shirt. Additionally, in such embodiments, the shin guard may include a plurality of second hook-and-loop fastener pads coupled to the rear surface. Each of the plurality of second hook-and-loop fastener pads may be configured to mate with one of the plurality of first hook-and-loop fastener pads of the baseball catcher's uniform to removably secure the shin guard to the baseball catcher's uniform pants.

The above and other features of the present disclosure will become apparent from the following description and the attached drawings.

DETAILED DESCRIPTION OF THE DRAWING

Figure 1:
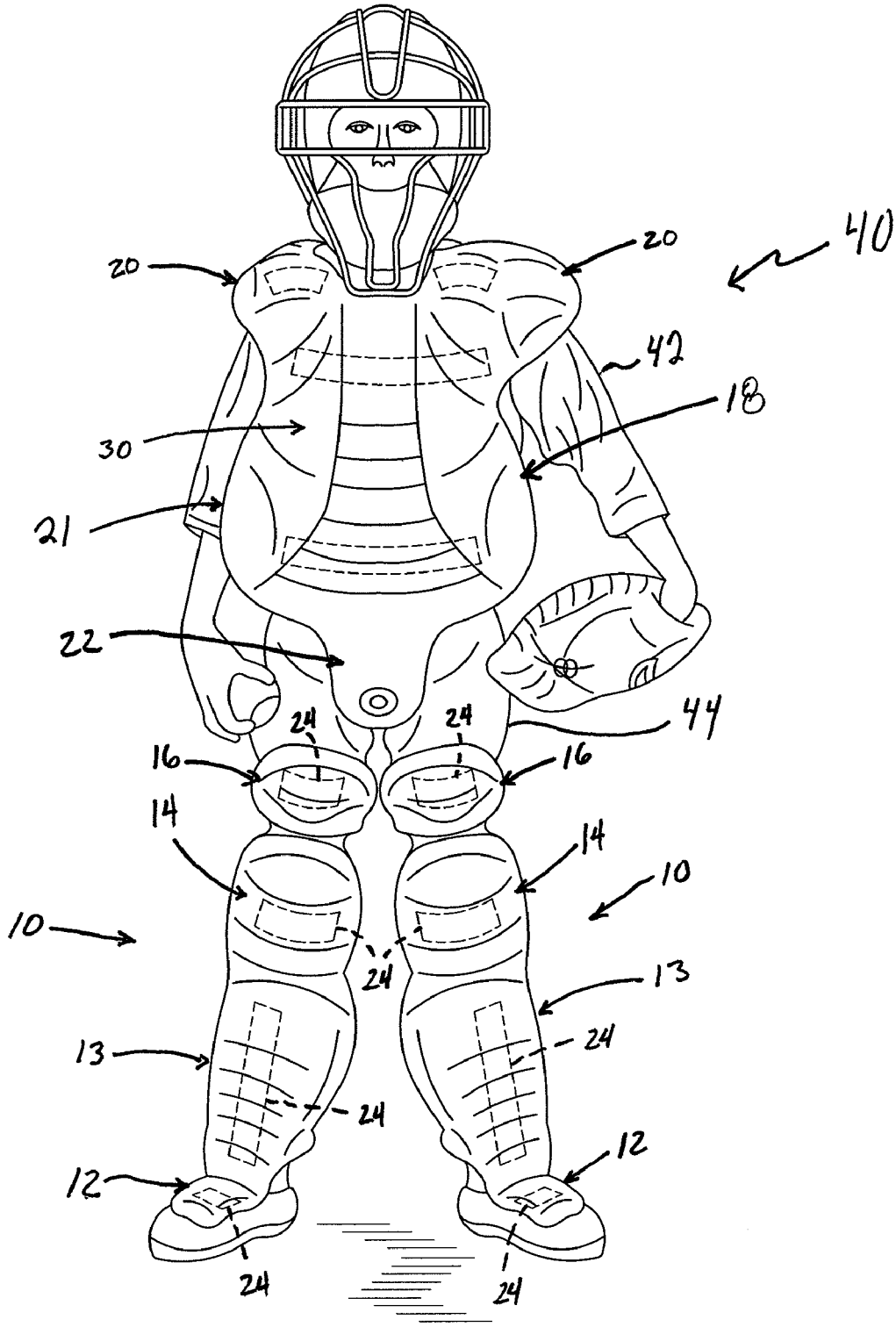
FIG. 1 is a perspective view showing a pair of shin guards and a chest protector coupled to an athlete's clothing.

While the concepts of the present disclosure are susceptible to various modifications and alternative forms, specific exemplary embodiments thereof have been shown by way of example in the drawings and will herein be described in detail. It should be understood, however, that there is no intent to limit the disclosure to the particular forms disclosed, but on the contrary, the intention is to cover all modifications, equivalents, and alternatives following within the spirit and scope of the invention as defined by the appended claims.

Referring to FIG. 1, there is shown a pair of shin guards 10 for protecting at least a portion of a leg of a baseball catcher. Each shin guard 10 includes an ankle guard portion 12, a shin guard portion 13, a knee guard portion 14, and a thigh guard portion 16. Illustratively, the shin guards 10 comprise a high strength-to-weight ratio material such as, for example, injection molded plastic, or polypropylene. Use of such material enhances the durability and thus the useful life of the shin guards 10. Each shin guard 10 further includes a front surface 13 and a rear surface 15. Each shin guard 10 is formed in a curved shape to conform to the shin area of a human body.

Referring again to FIG. 1, each shin guard 10 includes first hook-and-loop fastener pads 24 (shown in phantom) coupled to the rear surface 15. The first hook-and-loop fastener pads 24 are arranged to engage corresponding second hook-and-loop fastener pads 26 (see FIG. 2) coupled to an exterior surface 28 of a baseball catcher's uniform 40 (i.e., the baseball catcher's uniform pants 42). Hook-and-loop fastener pads 26 may be sewn or glued to the exterior uniform surface 28 or otherwise coupled thereto in any suitable fashion. In some embodiments, shin guards 10 may also be arranged having the entire rear surface 15 covered with hook-and-loop fasteners 24 (e.g., a hook-and-loop fastener pad 24 that substantially covers the entire rear surface 15).

Figure 2:
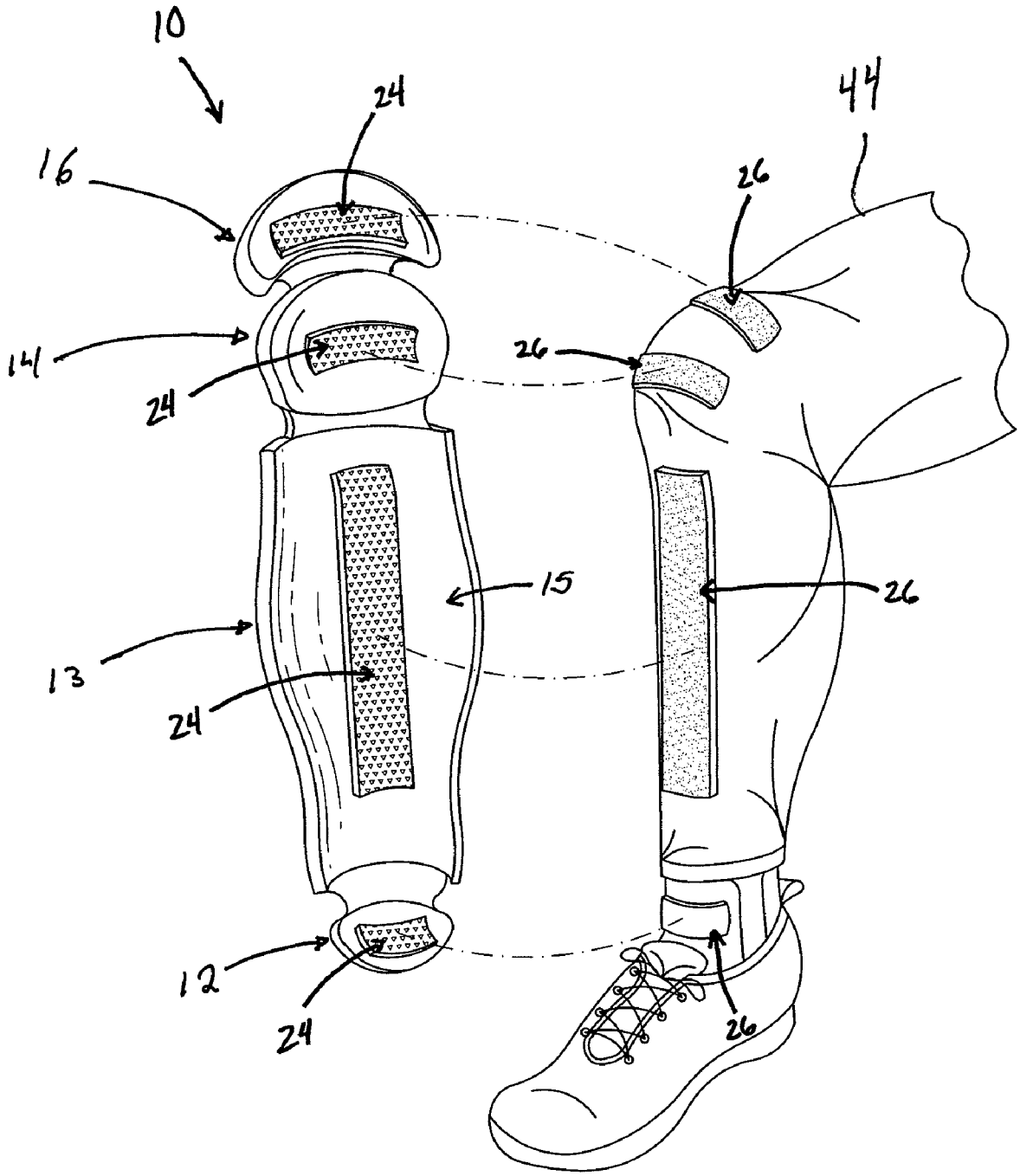
FIG. 2 is a perspective view of one of the shin guards of FIG. 1.

Referring to FIG. 2, the use of hook-and-loop fastener pads 24, 26 allows a user to attach the shin guards 10 to his body without the use of a strap or buckle fastener where, for example, a young player may be less adept to fastening or unfastening such fasteners. In operation, to put on the shin guards 10, the user aligns the hook-and-loop fastener pads 24 coupled to the rear surface 15 with the corresponding hook-and-loop fastener pads 26 coupled to the user's uniform surface 28 and presses the two pads together to cause the hook-and-loop fastener pads to couple. To remove the shin guards 10, the user pulls each shin guard 10 away from his leg to disengage the hook-and-loop fastener pads 24, 26.

Figure 3:
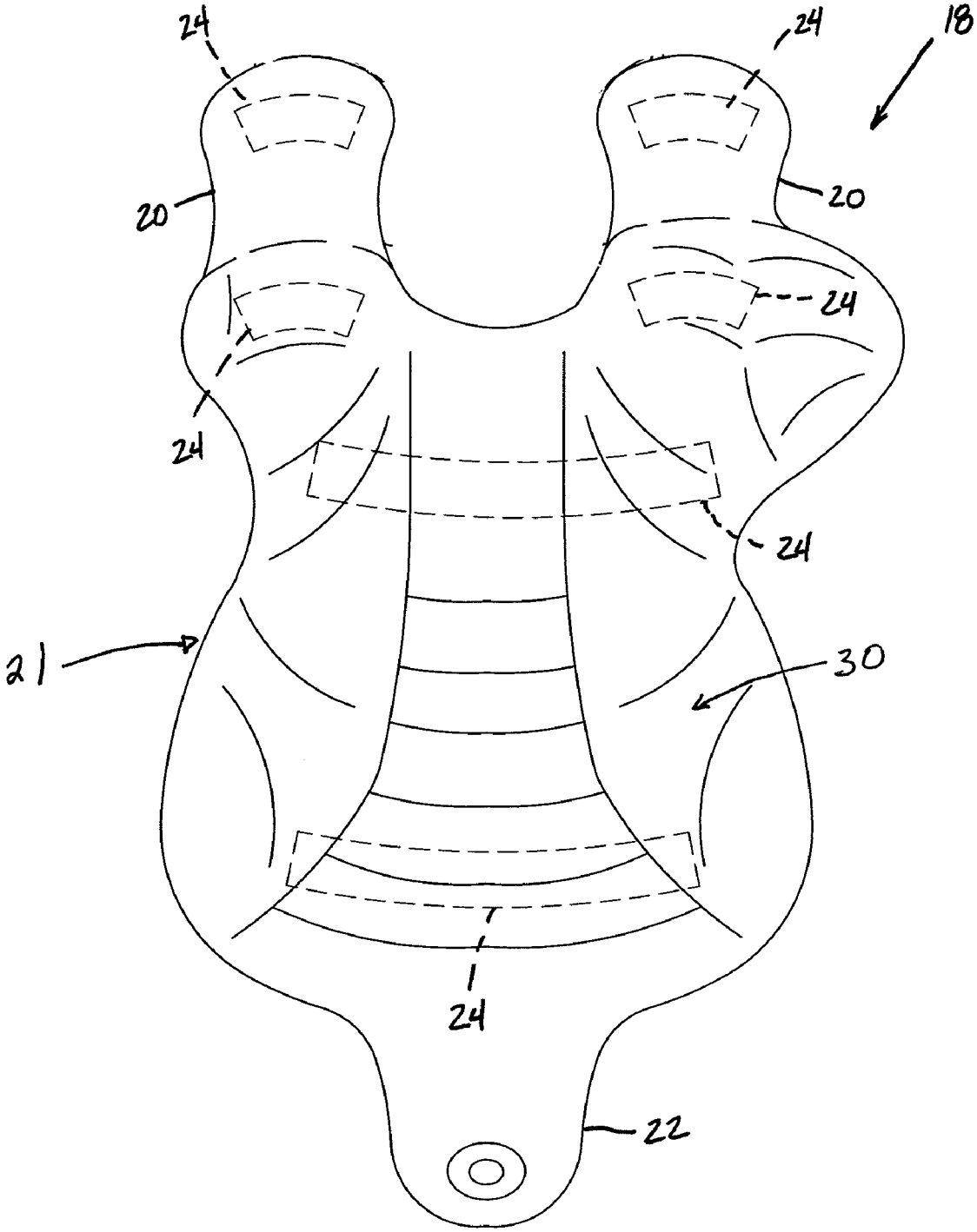
FIG. 3 is an elevation view of the chest protector of FIG. 1.

Referring to FIGS. 1 and 3, a chest protector 18 is also provided. The chest protector 18 includes a pair of shoulder guard portions 20, a chest and abdomen guard portion 21, and a crotch guard portion 22. The first hook-and-loop fastener pads 24 are arranged to engage corresponding second hook-and-loop fastener pads 26 coupled to an exterior surface 28 of the baseball catcher's uniform 40 (i.e., the baseball catcher's uniform shirt or jersey 44). The second hook-and-loop fastener pads 26 may be sewn or glued to the exterior uniform surface 28 or coupled thereto in any suitable fashion. In some embodiments, the chest protector 18 may also be arranged having the entire rear surface 32 covered with first hook-and-loop fasteners 24.

Illustratively, the chest protector 18 is made of a padded material such as, for example, nylon web, cotton ducking, or any other suitable material being sufficiently flexible to conform to the upper torso of the user when worn. Each chest protector 18 further includes a front surface 30 and a rear surface 32 (not shown). In operation, the chest protector 18 is worn and removed in the same manner as shin guards 10.

The use of hoop and loop fasteners to secure catcher's equipment to an athlete as described above provides a number of advantages. Unexpectedly, the use of such fasteners adequately secures the equipment to young athletes such as young children playing tee ball, pee wee ball, or other youth leagues. Indeed, much of the time between innings of a youth baseball or softball game is spent equipping the catcher. This is caused by the amount of time and effort associated with manipulating the multiple straps on conventional gear. However, the concepts of the present disclosure eliminate such drawbacks. It is recognized that the concepts of the present disclosure may not be applicable for all levels of play. For example, unlike youth players, more advanced athletes may require equipment that uses conventional straps.

In some embodiments, the baseball catcher's uniform 40 may also include a plurality of slide guards, which may be attached to the exterior uniform surface 28 of the baseball catcher's uniform pants 42 and/or shirt 44. The slide guards are configured to reduce the likelihood of injury to the baseball catcher during play from, for example, sliding into base or the like. For example, the slide guards may provide protection for the baseball catcher during those periods of time when the baseball catcher is not donning the shin guard 10 and chest protector 18 (e.g., when the baseball catcher is "at bat"). The slide guards may be embodied as areas or pads of material configured to protect the wearer from abrasions, bumps, and/or the like. The slide guards may be formed from a material of higher durability than the fabric that forms the other portions of the uniform 40. For example, the slide guards may be formed from a rubber or plastic material and may be flexible or rigid. The slide guards are positioned at particular points of the baseball catcher's body such as the elbow and/or knee region of the uniform 40. The slide guards may be secured to the exterior uniform surface 28 of the baseball catcher's uniform 40 via any suitable securing means such as stitching, glue, or the like or may form an integral portion of the uniform 40. The outer surface of the slide guards may be substantially flat or may include bumps, ridges, and/or other projections to provide additional protection to the wearer.

While the concepts of the present disclosure have been illustrated and described in detail in the drawings and foregoing description, such illustration and description is to be considered as exemplary and not restrictive in character, it being understood that only illustrative embodiments have been shown and described and that all changes and modifications that come within the spirit of the disclosure are desired to be protected.

There are a plurality of advantages of the concepts of the present disclosure arising from the various features of the systems described herein. It will be noted that alternative embodiments of each of the systems of the present disclosure may not include all of the features described yet still benefit from at least some of the advantages of such features. Those of ordinary skill in the art may readily devise their own implementations of a system that incorporate one or more of the features of the present disclosure and fall within the spirit and scope of the invention as defined by the appended claims.

The invention claimed is:

1. An article comprising:

a baseball catcher's uniform pants sized for use by a child, the baseball catcher's uniform pants including an exterior surface and a first hook-and-loop fastener pad coupled to the exterior surface;

a shin guard sized for use by a child, the shin guard including an ankle guard portion having a rear surface and at least one second hook-and-loop fastener pad coupled to the rear surface, a shin guard portion having a rear surface and at least one second hook-and-loop fastener pad coupled thereto, a knee guard portion having a rear surface and at least one second hook-and-loop fastener pad coupled thereto, and a thigh guard portion having a rear surface and at least one second hook-and-loop fastener pad coupled thereto, the first hook-and-loop fastener pad and the second hook-and-loop fastener pads being configured to mate with each other to removably secure the shin guard to the baseball catcher's uniform pants.

2. The article of claim 1, wherein the first hook-and-loop fastener pad comprises a hook type fastener pad and the second hook-and-loop fastener pad comprises a loop type fastener pad.

3. The article of claim 1, wherein the first hook-and-loop fastener pad comprises a loop type fastener pad and the second hook-and-loop fastener pad comprises a hook type fastener pad.

4. The article of claim 1, wherein:

the baseball catcher's uniform pants comprises a plurality of first hook-and-loop fastener pads coupled to the exterior surface, and each of the plurality of second hook-and-loop fastener pads on the shin guard being configured to mate with one of the plurality of first hook-and-loop fastener pads to removably secure the shin guard to the baseball catcher's uniform pants.

5. The article of claim 1, wherein each of the second hook-and-loop fastener pads are configured to mate with a corresponding first hook-and-loop fastener pad coupled to exterior surface of the baseball catcher's uniform pants.

6. An article comprising:

a baseball catcher's uniform shirt sized for use by a child, the baseball catcher's uniform shirt including an exterior surface and a first hook-and-loop fastener pad coupled to the exterior surface;

a chest guard sized for use by a child, the chest guard including a shoulder guard portion having a rear surface and at least one a second hook-and-loop fastener pad coupled to the rear surface and a chest and abdomen guard portion having a rear surface and at least one second hook-and-loop fastener pad coupled to the rear surface and a crotch guard portion, the first hook-and-loop fastener pad and the second hook-and-loop fastener pads being configured to mate with each other to removably secure the chest guard to the baseball catcher's uniform shirt.

7. The article of claim 6, wherein the first hook-and-loop fastener pad comprises a hook type fastener pad and the second hook-and-loop fastener pad comprises a loop type fastener pad.

8. The article of claim 6, wherein the first hook-and-loop fastener pad comprises a loop type fastener pad and the second hook-and-loop fastener pad comprises a hook type fastener pad.

9. The article of claim 6, wherein:

the baseball catcher's uniform shirt comprises a plurality of first hook-and-loop fastener pads coupled to the exterior surface, and each of the plurality of second hook-and-loop fastener pads on the chest guard being configured to mate with one of the plurality of first hook-and-loop fastener pads to removably secure the chest guard to the baseball catcher's uniform shirt.

10. The article of claim 6, wherein each of the second hook-and-loop fastener pads are configured to mate with a corresponding first hook-and-loop fastener pad coupled to exterior surface of the baseball catcher's uniform shirt.

* * * * *